US008007607B2

(12) United States Patent
Daniels et al.

(10) Patent No.: US 8,007,607 B2
(45) Date of Patent: Aug. 30, 2011

(54) COMBUSTIBLE STRUCTURAL COMPOSITES AND METHODS OF FORMING COMBUSTIBLE STRUCTURAL COMPOSITES

(75) Inventors: Michael A. Daniels, Idaho Falls, ID (US); Ronald J. Heaps, Idaho Falls, ID (US); Eric D Steffler, Idaho Falls, ID (US); William D. Swank, Idaho Falls, ID (US)

(73) Assignee: Battelle Energy Alliance, LLC, Idaho Falls, ID (US)

( * ) Notice: Subject to any disclaimer, the term of this patent is extended or adjusted under 35 U.S.C. 154(b) by 308 days.

(21) Appl. No.: 12/233,639

(22) Filed: Sep. 19, 2008

(65) Prior Publication Data

US 2010/0071813 A1 Mar. 25, 2010

(51) Int. Cl.

| | |
|---|---|
| ***C06B 45/00*** | (2006.01) |
| ***C06B 45/04*** | (2006.01) |
| ***C06B 33/00*** | (2006.01) |
| ***D03D 23/00*** | (2006.01) |
| ***D03D 43/00*** | (2006.01) |

(52) U.S. Cl. ..... 149/15; 149/2; 149/17; 149/37; 149/108.2; 149/108.8; 149/109.2; 149/109.4; 149/109.6

(58) Field of Classification Search ..... 149/15, 149/2, 17, 37, 108.2, 108.8, 109.2, 109.4, 149/109.6

See application file for complete search history.

(56) References Cited

U.S. PATENT DOCUMENTS

| | | | | |
|---|---|---|---|---|
| 4,365,558 | A | 12/1982 | Lippler et al. | |
| 5,237,927 | A | 8/1993 | Gonzalez et al. | |
| 5,589,662 | A * | 12/1996 | Schleicher et al. | 149/35 |
| 5,718,113 | A | 2/1998 | Hayes | |
| 6,782,693 | B1 | 8/2004 | Floyd | |
| 6,910,422 | B2 | 6/2005 | Haider et al. | |
| 7,210,282 | B1 | 5/2007 | Floyd | |
| 2005/0199323 | A1 * | 9/2005 | Nielson et al. | 149/19.3 |
| 2005/0281968 | A1 | 12/2005 | Shanholtz et al. | |
| 2007/0277914 | A1 * | 12/2007 | Hugus et al. | 149/19.92 |

* cited by examiner

*Primary Examiner* — James E McDonough
(74) *Attorney, Agent, or Firm* — Holland & Hart, LLP

(57) ABSTRACT

Combustible structural composites and methods of forming same are disclosed. In an embodiment, a combustible structural composite includes combustible material comprising a fuel metal and a metal oxide. The fuel metal is present in the combustible material at a weight ratio from 1:9 to 1:1 of the fuel metal to the metal oxide. The fuel metal and the metal oxide are capable of exothermically reacting upon application of energy at or above a threshold value to support self-sustaining combustion of the combustible material within the combustible structural composite. Structural-reinforcing fibers are present in the composite at a weight ratio from 1:20 to 10:1 of the structural-reinforcing fibers to the combustible material. Other embodiments and aspects are disclosed.

25 Claims, 11 Drawing Sheets

COMBUSTIBLE STRUCTURAL COMPOSITES AND METHODS OF FORMING COMBUSTIBLE STRUCTURAL COMPOSITES

GOVERNMENT RIGHTS

This invention was made with government support under Contract Number DE-AC07-05ID14517 awarded by the United States Department of Energy. The government has certain rights in the invention.

TECHNICAL FIELD

This invention relates to combustible structural composites and to methods of forming combustible structural composites.

BACKGROUND OF THE INVENTION

In certain applications, primarily military, vehicles are used to carry a payload to a location of interest. The vehicles might be of land, sea, or air, or some combination thereof and may be manned or unmanned. The payload might be personnel and/or equipment. In some instances, the payload/personnel/cargo is unloaded or used at a location of interest with the vehicle left behind after serving its primary purpose of delivering the payload to such location. An enemy or undesired persons may thereby have access to, or use of, the vehicle.

Furthermore, in some applications, it might be desirable to transport structures and/or equipment to a desired location in an assembled or unassembled condition. Upon serving its purposes, the structure(s) or equipment might need to be left behind, and to which an enemy or others might undesirably have access. It would be desirable to enable vehicles, structures, and/or equipment to be readily disposed of after such have served their useful purpose and/or to preclude such from being accessed by undesirable entities.

While the invention was motivated in addressing the above-identified issues, it is in no way so limited. The invention is only limited by the accompanying claims as literally worded, without interpretative or other limiting reference to the specification, and in accordance with the doctrine of equivalents.

BRIEF DESCRIPTION OF THE DRAWINGS

Preferred embodiments of the invention are described below with reference to the following accompanying drawings.

FIG. 27 is a diagrammatic isometric view of a combustible structural composite during manufacture in accordance with an embodiment of the invention.

DETAILED DESCRIPTION OF THE PREFERRED EMBODIMENTS

This disclosure of the invention is submitted in furtherance of the constitutional purposes of the U.S. Patent Laws "to promote the progress of science and useful arts" (Article 1, Section 8).

Aspects of the invention encompass combustible structural composites and methods of forming combustible structural composites. Such composites might be used in any number of existing, or yet-to-be developed, manners. For example, and by way of example only, such might be used as structural load-bearing components of a vehicle. For example, a combustible structural composite might be used as a structural supporting component of an aircraft wing or fuselage (including the skins thereof), and/or sub-structural components of a wing or fuselage. Alternately by way of example, combustible structural composites as described herein might be used as load-bearing structure for land, sea, and/or amphibious vehicles. Further by way of example only, combustible structural composites as described herein might be utilized as structural load-bearing components of a building, equipment, or articles of manufacture other than vehicles. Examples include planar and non-planar sheets that might be used as a surface or an internal structural component of an article of manufacture, of course, including vehicles. Regardless, such load-bearing structural composites will be capable of partial or complete destruction by self-sustaining combustion as described herein. Thereby, a user can selectively choose to destroy wholly or partially a structure or piece of equipment by choosing to selectively cause the structural load-bearing composite to burn.

Figure 1:
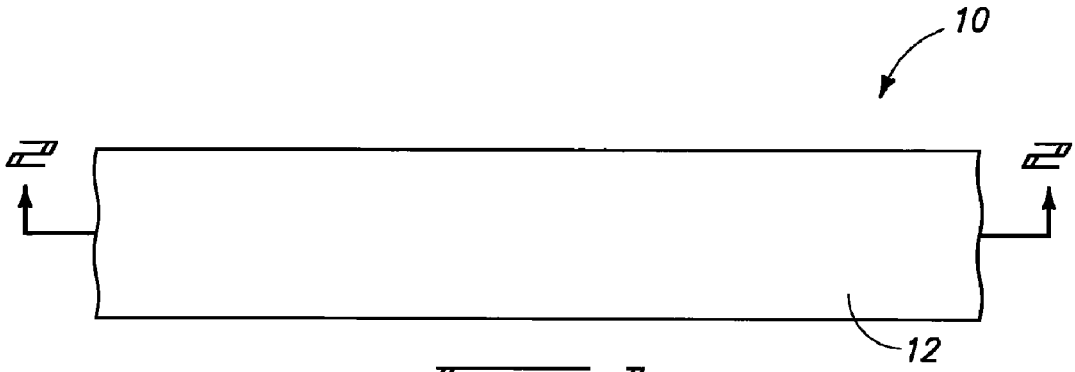
FIG. 1 is a diagrammatic top view of a combustible structural composite in accordance with an embodiment of the invention.
Figure 2:
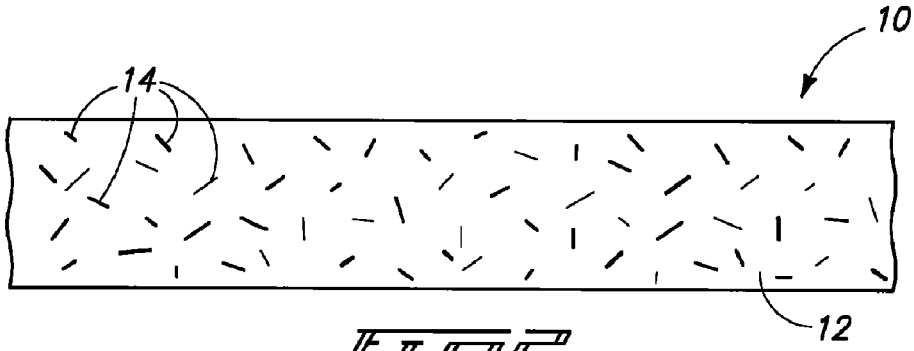
FIG. 2 is a cross-sectional view taken through section line 2-2 of FIG. 1.

Several embodiments are described below that might be used in the fabrication of structural load-bearing components of vehicles, buildings, other structures and/or equipments, and by way of example only. Referring initially to FIGS. 1 and 2, a combustible structural composite is indicated generally with reference numeral 10. Such is by way of example only, and for convenience of discussion, depicted in the form of an elongated, square cross-sectioned rod. However, any alternate configuration or shape is contemplated, whether existing or yet-to-be developed. For example, such configurations or shapes might be of a circular cross-section, and/or an expansive thin sheet, and/or other than extending substantially straight and/or linear.

Combustible structural composite 10 is depicted as comprising combustible material 12 and structural-reinforcing fibers 14. The combustible material 12 comprises a fuel metal and a metal oxide. The fuel metal might be in an elemental form, including a plurality of different metal elements in an elemental form. Alternately by way of example, the fuel metal might be an alloy of elemental metals. Specific examples include aluminum, titanium, zirconium, and magnesium, whether used either alone or in any combination, or as an alloy. In one embodiment, the fuel metal comprises aluminum in alloy form, for example, magnalium.

A variety of metal oxides might be used. Specific preferred examples are shown in the TABLE below with respect to example fuel metals.

TABLE

| Fuel Metals | Al | Ti | Zr | Mg |
|---|---|---|---|---|
| Metal Oxides | Ag | | | |
| | B | B | B | B |
| | Bi | | | |
| | Co | | | |
| | Cr | Cr | Cr | Cr |
| | Cu | Cu | Cu | Cu |
| | Fe | Fe | Fe | Fe |
| | Hg | | | |
| | I | | | |
| | Mn | Mn | Mn | Mn |
| | Mo | | | |
| | Nb | | | |
| | Ni | | | |
| | Pb | Pb | Pb | Pb |
| | Pd | | | |
| | Si | Si | Si | Si |
| | Sn | | | |
| | Ta | | | |
| | Ti | | | |
| | U | | | |
| | V | | | |
| | W | | | |

The fuel metal is present in the combustible material at a weight ratio from 1:9 to 1:1 of the fuel metal to the metal oxide. In one preferred embodiment, the fuel metal is present in the combustible material at a weight ratio from 1:4 to 3:7 of the fuel metal to the metal oxide. The fuel metal and the metal oxide are provided to be capable of exothermically reacting upon application of energy at or above a threshold value to support self-sustaining combustion of the combustible material within the combustible structural composite 10.

A plurality of structural-reinforcing fibers 14 are present in the combustible structural composite 10 at a weight ratio of from 1:20 to 10:1 of structural-reinforcing fibers 14 to combustible material 12. In one preferred embodiment, structural-reinforcing fibers 14 are present in the combustible structural composite 10 at a weight ratio from 1:2 to 2:1 of the structural-reinforcing fibers 14 to the combustible material 12. The structural-reinforcing fibers 14 may or may not be combustible or consumed upon self-sustaining combustion of the combustible material 12 within the combustible structural composite 10, and typically will not be inherently capable of supporting self-sustaining combustion. Fuel metal and metal oxide combustible materials typically contain a ceramic phase that makes such too brittle for use as structural supporting members, in place of metals such as aluminum or steel. Such brittle nature makes such combustible materials unable to carry any meaningful tensile load that is essential in most structural applications. Addition of reinforcing material such as structural-reinforcing fibers may result in a composite effectively capable of carrying significant structural design loads in addition to providing increased fracture toughness in comparison to the combustible material alone. Exemplary structural-reinforcing fibers include one or more of glass fibers (i.e., fiberglass), carbon fibers, and aramid fibers (i.e., KEVLAR®). In another example, the fibers may be of a composition comprising the fuel metal, including fibers of a composition consisting essentially of the fuel metal. Regardless, the fibers may be of uniform length and diameter or of variable lengths and/or diameters. Regardless, an example diameter range for structural-reinforcing fibers 14 is from $4\times10^{-5}$ inch to 0.1 inch, and an example length range is from 0.050 inch to 12 inches. Other diameters and/or lengths may be used.

Application of energy sufficient to support self-sustaining combustion of the combustible material 12 within the combustible structural composite 10 might occur by any existing or yet-to-be developed manner. Further, selection of the fuel metal and metal oxide compositions and weight ratio relative to one another will impact the threshold energy required to support self-sustaining combustion. Accordingly, the quantity and manner of applying energy may vary upon composition and concentration of materials. For example, compositions may be fabricated such that self-sustaining combustion can be initiated by a conventional match. Further and by way of example only, higher or lower energy application for a given material might occur by application of electrical impulse, or microwave or other radiation exposure. Furthermore, some sort of an initiator might be provided as part of the combustible structural composite 10, or separately from the combustible structural composite 10 to enable initiation of self-sustaining combustion. For example, a suitable incendiary composition might be provided that can be caused to ignite by a lower energy input (i.e., by a match) to initiate burning thereof at a higher temperature that initiates self-sustaining combustion of combustible material 12 at the higher temperature.

As a specific example, a combustible structural composite 10 comprising combustible material 12 of 25.3% by weight aluminum and 74.7% by weight iron oxide will burn once heated to approximately 800° C. The products are alumina, iron and 4 KJ/g of heat. The adiabatic flame temperature for the reaction is greater than 2000° C.

Dimensions and thickness of combustible structural composite 10 can be selected by a person of ordinary skill in the art depending upon resultant strength of the combustible structural composite 10 and the load carrying configuration desired for a structural supporting member of which the combustible structural composite 10 would be a part. Further, additional material might be present within, or in addition to, combustible material 12 and structural-reinforcing fibers 14.

FIGS. 1 and 2 depict one example embodiment wherein structural-reinforcing fibers 14 are both received within combustible material 12, and are in direct physical touching contact therewith. Regardless and although not specifically shown in FIGS. 1 and 2, structural-reinforcing fibers 14 may extend to one or more outer surfaces of combustible structural composite 10. FIG. 2 also depicts an embodiment wherein structural-reinforcing fibers 14 are distributed substantially homogenously within combustible material 12. Alternate embodiments depicting other than homogenous fiber distribution are depicted, by way of example only, in FIGS. 3, 4, 5 and 6, with respect to combustible structural composites 10*a*, 10*b*, 10*c*, and 10*d*, respectively. Like numerals from the first-described embodiment are utilized where appropriate, with differences being indicated with the suffixes "a," "b," "c," or "d."

Figure 3:
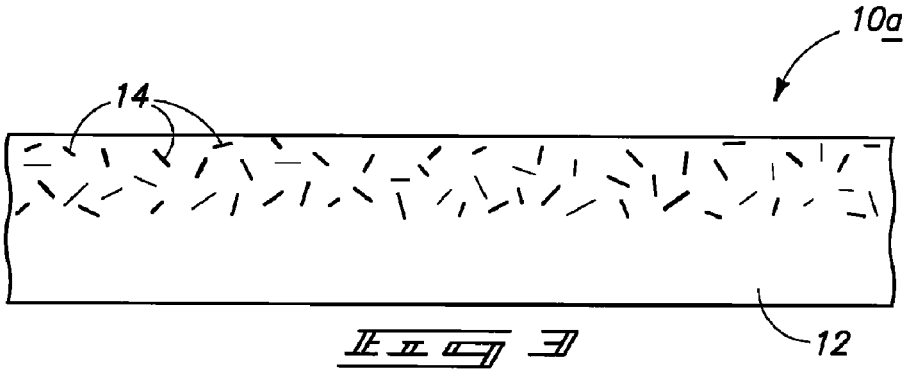
FIG. 3 is an alternate embodiment of a combustible structural composite to that shown in FIG. 2.
Figure 4:
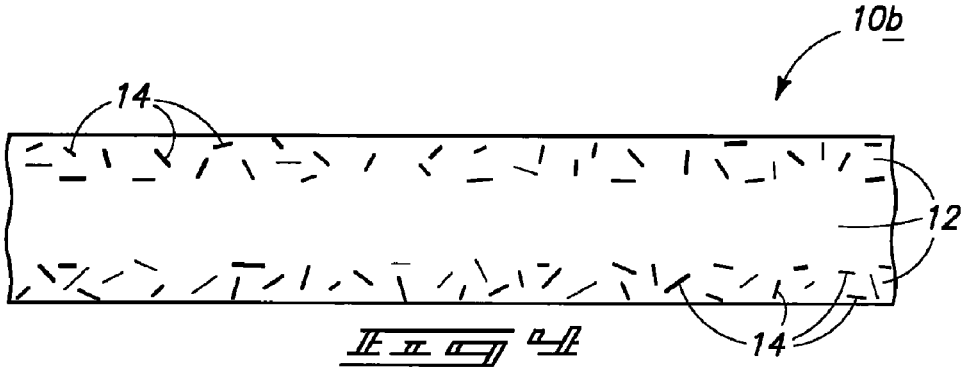
FIG. 4 is an alternate embodiment of a combustible structural composite to that shown in FIG. 2.
Figure 5:
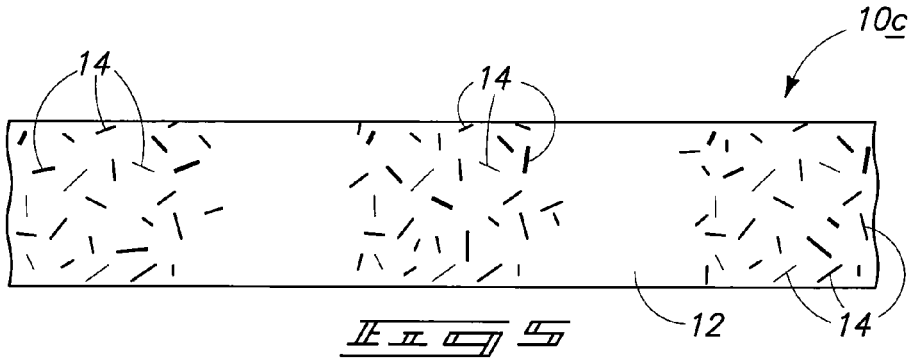
FIG. 5 is an alternate embodiment of a combustible structural composite to that shown in FIG. 2.
Figure 6:
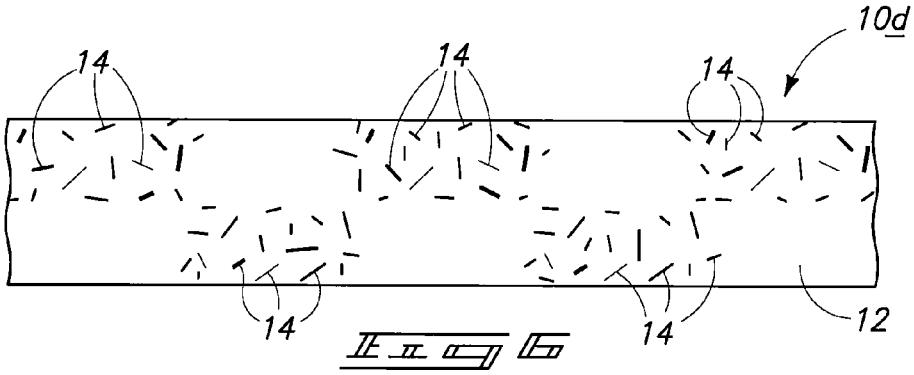
FIG. 6 is an alternate embodiment of a combustible structural composite to that shown in FIG. 2.

FIG. 3 depicts an embodiment wherein structural-reinforcing fibers 14 are concentrated to one side of combustible structural composite 10*a*. FIG. 4 depicts an alternate embodiment wherein structural-reinforcing fibers 14 are concentrated at opposing surfaces of combustible structural composite 10*b* and away from central portions thereof. FIGS. 5 and 6 depict alternate embodiment combustible structural composites 10*c* and 10*d*, respectively, having different spaced concentrated regions of structural-reinforcing fibers 14. FIGS. 3-6 are exemplary non-homogenous fiber distribution embodiments only, and alternate configurations are also, of course, contemplated.

Figure 7:
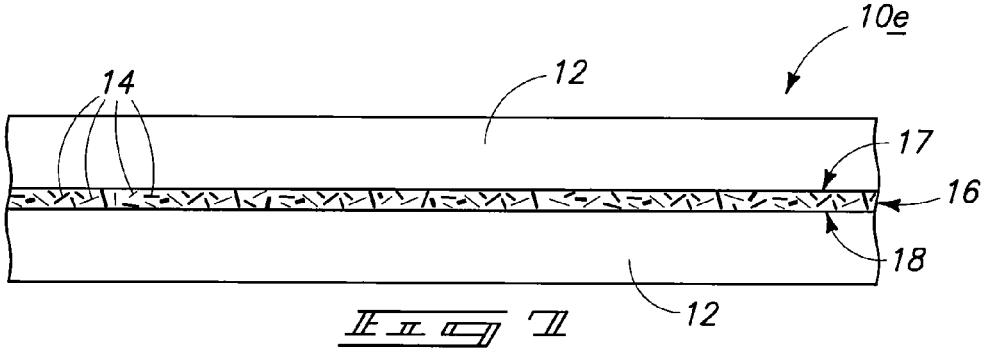
FIG. 7 is an alternate embodiment of a combustible structural composite to that shown in FIG. 2.

For example, FIG. 7 depicts an alternate example combustible structural composite 10*e* wherein the structural-reinforcing fibers 14 are provided in the combustible structural composite 10 as a self-supporting sheet. Like numerals from the first described embodiment have been utilized where appropriate, with differences being indicated with the suffix "e" or with different numerals. Combustible structural composite 10*e* is depicted as comprising a sheet 16 composed of structural-reinforcing fibers 14. For purposes of the continuing discussion, such can be considered as having opposing sides 17, 18 that are both covered by, and in physical contact with, combustible material 12. Structural-reinforcing fibers 14 may or may not be distributed substantially homogenously within sheet 16. In addition thereto, structural-reinforcing fibers (not shown) might be homogenously or otherwise distributed throughout combustible material 12 on one or both sides of sheet 16. An example thickness range for sheet 16, which comprises structural-reinforcing fibers 14, is from 0.10 inch to 0.1 inch. Alternate thicknesses might of course be used.

Figure 8:
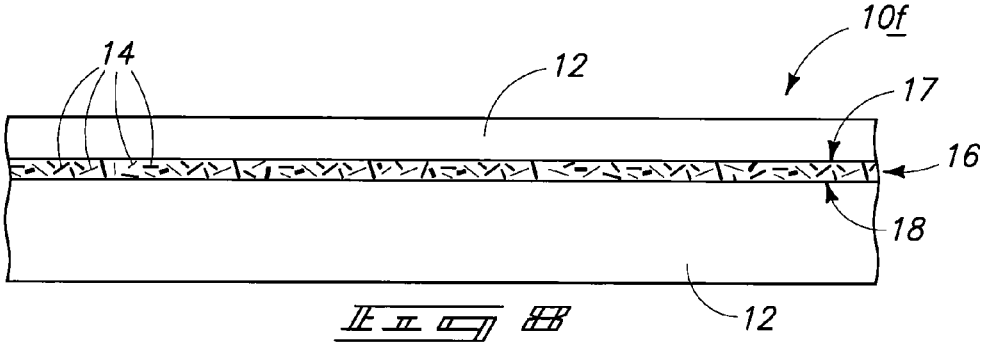
FIG. 8 is an alternate embodiment of a combustible structural composite to that shown in FIG. 2.

FIG. 7 depicts an embodiment wherein sheet 16 is essentially centered within combustible material 12. FIG. 8 depicts an alternate embodiment of combustible structural composite 10*f*, wherein sheet 16 is provided to be other than centered within combustible material 12. Like numerals from the FIG. 7 embodiment have been utilized, with differences being indicated with the suffix "f."

Figure 9:
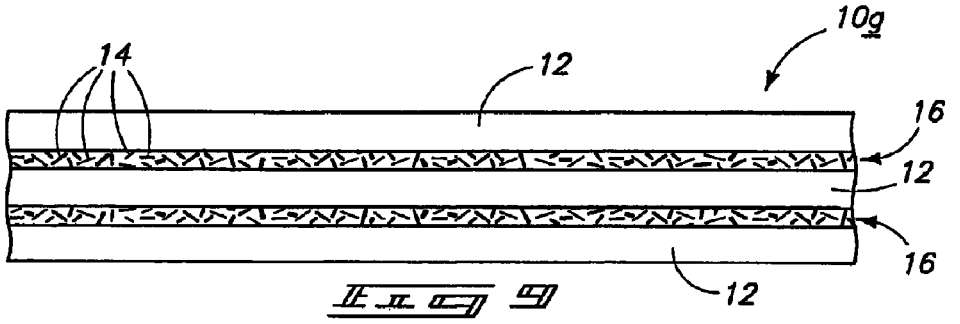
FIG. 9 is an alternate embodiment of a combustible structural composite to that shown in FIG. 2.

FIGS. 7 and 8 depict example embodiments wherein a single sheet 16 is provided within the respective combustible structural composite 10*e*, 10*f*. FIG. 9 depicts a combustible structural composite 10*g* wherein multiple sheets 16 have been provided within combustible material 12. Like numerals from FIGS. 7 and 8 embodiments have been utilized where appropriate, with differences being indicated with a suffix "g."

Figure 10:
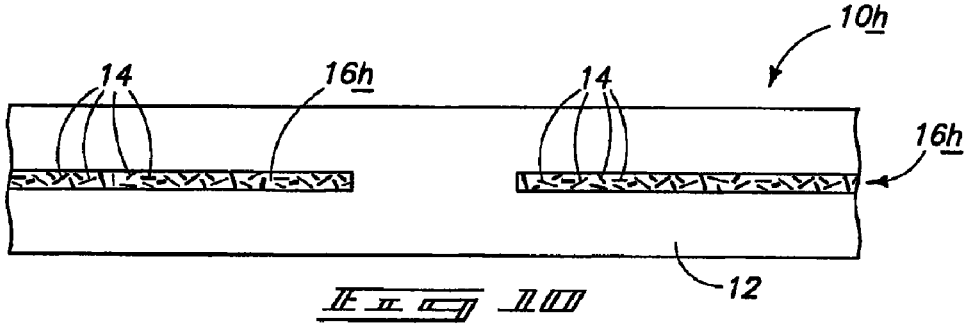
FIG. 10 is an alternate embodiment of a combustible structural composite to that shown in FIG. 2.

The above-mentioned FIGS. 7-9 embodiments depict one or more sheets 16 including structural-reinforcing fibers 14 provided in one or more continuous sheets that substantially spans the respective combustible structural composite 10*e*, 10*f*, 10*g*. FIG. 10 depicts an alternate embodiment of a combustible structural composite 10*h* having a plurality of sheets 16*h* that include structural-reinforcing fibers 14 and do not span entirely along combustible structural composite 10*h*. Like numerals from the above-described FIGS. 7-9 embodiments have been utilized where appropriate, with differences being indicated with the suffix "h."

Figure 11:
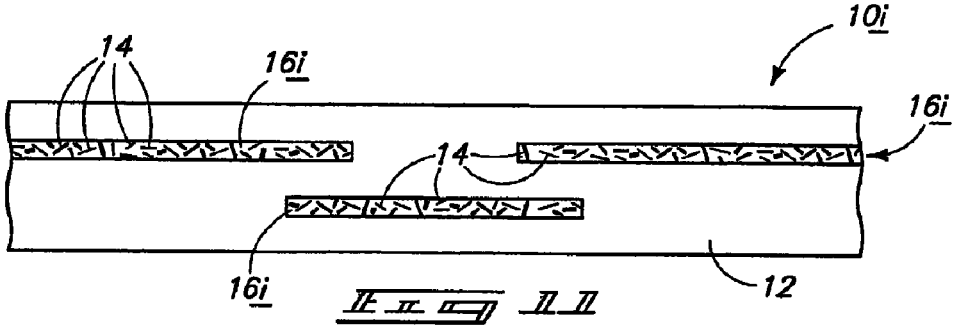
FIG. 11 is an alternate embodiment of a combustible structural composite to that shown in FIG. 2.

FIG. 11 illustrates another exemplary embodiment of combustible structural composite 10*i* having a plurality of overlapping sheets 16*i* having structural-reinforcing fibers 14. Like numerals from the FIG. 10 embodiment have been utilized, with differences being indicated with the suffix "i."

Figure 12:
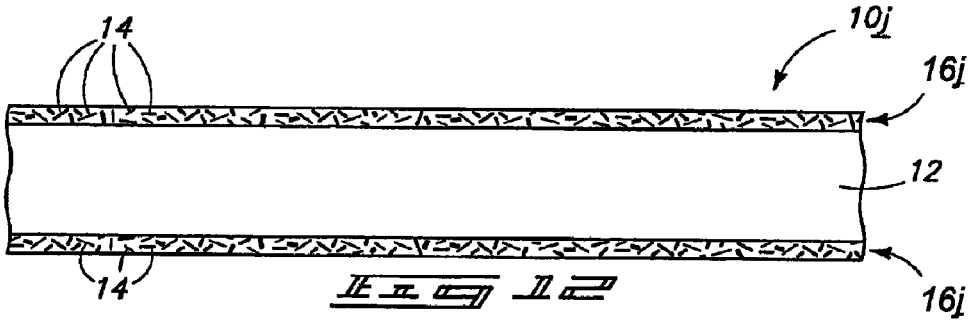
FIG. 12 is an alternate embodiment of a combustible structural composite to that shown in FIG. 2.

FIG. 12, by way of example only, depicts another embodiment of combustible structural composite 10*j* comprising a plurality of sheets 16*j*. Like numerals from the embodiments of FIGS. 7-11 have been utilized where appropriate, with differences being indicated with the suffix "j." FIG. 12 depicts combustible structural composite 10*j* as comprising two sheets 16, including structural-reinforcing fibers 14 with combustible material 12 being sandwiched therebetween. FIG. 12 also depicts an example embodiment wherein combustible material 12 is provided to cover only a single surface among a plurality of opposing major surfaces of each sheet 16.

Figure 13:
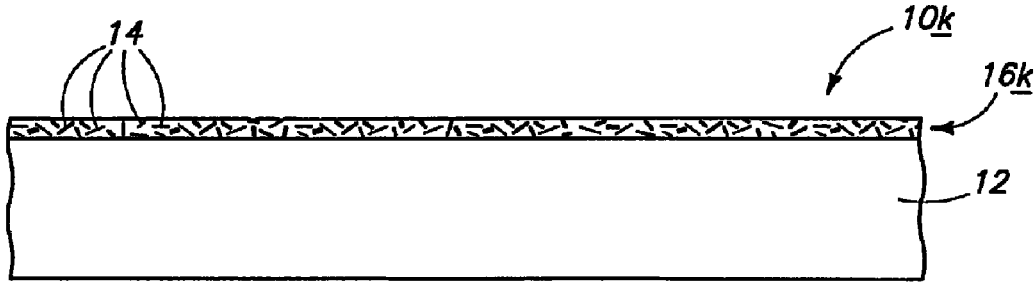
FIG. 13 is an alternate embodiment of a combustible structural composite to that shown in FIG. 2.

FIG. 13 illustrates yet another alternate example of an embodiment of combustible structural composite 10*k*. Like numerals from the FIG. 12 embodiment have been utilized, with differences being indicated with the suffix "k." FIG. 13 depicts an embodiment employing only a single sheet 16*k* including structural-reinforcing fibers 14.

Figure 14:
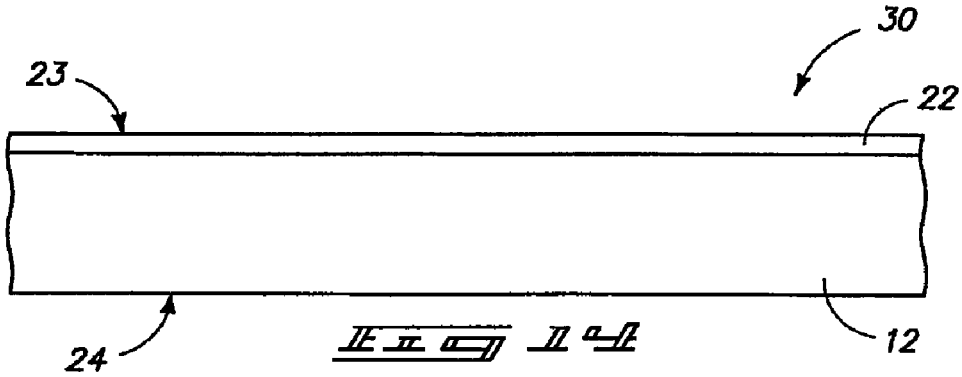
FIG. 14 is an alternate embodiment of a combustible structural composite to that shown in FIG. 2.

Embodiments of the invention also encompass combustible structural composites 10 comprising the above-described combustible material 12 in combination with a structural load-bearing sheet that is bonded thereto, with the structural load-bearing sheet being present in the combustible structural composite 10 at a weight ratio from 1:20 to 10:1 of the structural load-bearing sheet to the combustible material. For example, FIG. 14 depicts such an example of combustible structural composite 30. Like numerals from the above-described embodiments have been utilized where appropriate, with differences being indicated with different numerals. Combustible structural composite 30 comprises combustible material 12 and a structural load-bearing sheet 22, which is bonded thereto. Structural load-bearing sheet 22 might be bonded to or with combustible material 12 with a suitable adhesive (not shown) or by application of liquid material to structural load-bearing sheet 22 followed by solidification thereof into combustible material 12, for example, as described below. In one example, structural load-bearing sheet 22 is composed or comprised of metal, for example, steel, aluminum, or other structural load-bearing metals. In one example, structural load-bearing sheet 22 may be of a composition comprising the fuel metal, including a composition consisting essentially of the fuel metal. Fiber-comprising sheets might also be utilized, with any of FIGS. 7-13 depicting example combustible structural composites 10 comprising combustible material 12 and at least one structural load-bearing sheet that may or may not be bonded with combustible material 12.

Figure 15:
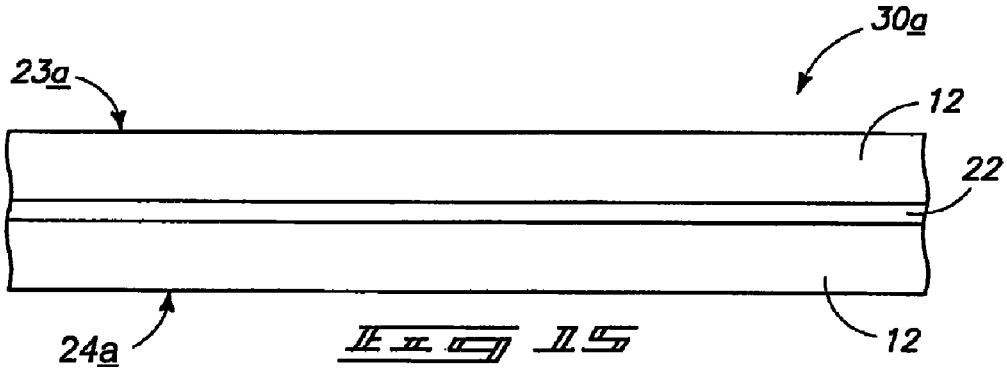
FIG. 15 is an alternate embodiment of a combustible structural composite to that shown in FIG. 2.

FIG. 14 depicts one embodiment wherein a combustible structural composite 30 comprises a plurality of opposing major surfaces 23 and 24, with structural load-bearing sheet 22 comprising one of such opposing major surfaces. FIG. 15 depicts an alternate embodiment combustible structural composite 30*a* wherein structural load-bearing sheet 22 is substantially centered between opposing major surfaces 23*a* and 24*a*. Like numerals from the FIG. 14 embodiment have been utilized, with differences being indicated with the suffix "a."

Figure 16:
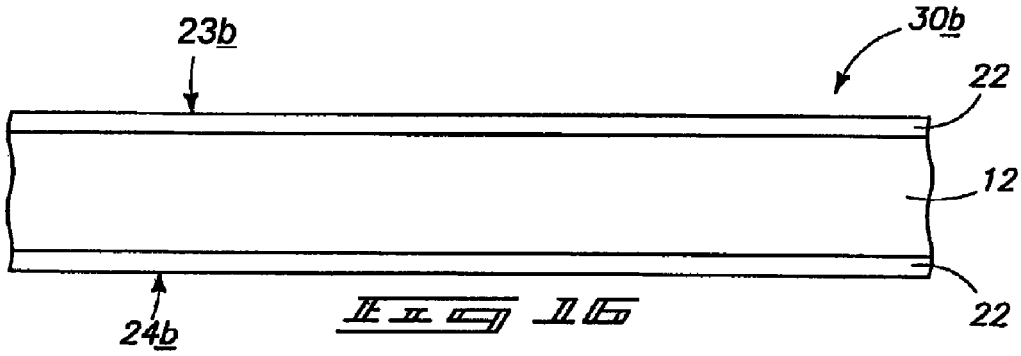
FIG. 16 is an alternate embodiment of a combustible structural composite to that shown in FIG. 2.

FIG. 16 depicts yet another alternate embodiment of combustible structural composite 30*b*. Like numerals from the FIGS. 14 and 15 embodiments have been utilized, with differences being indicated with the suffix "b." Combustible structural composite 30*b* comprises a plurality of structural load-bearing sheets 22 collectively present in the combustible structural composite 30*b* at a weight ratio from 1:20 to 10:1 of the structural load-bearing sheets 22 to the combustible material 12.

Figure 17:
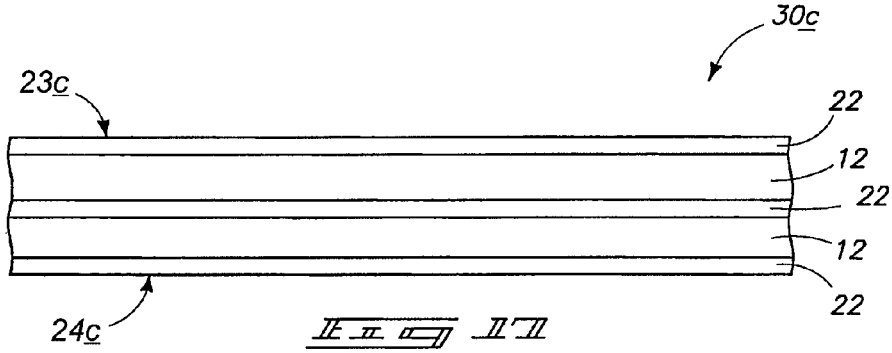
FIG. 17 is an alternate embodiment of a combustible structural composite to that shown in FIG. 2.

FIG. 17 illustrates yet another embodiment of combustible structural composite 30*c*. Like numerals from the FIGS. 14-16 embodiments have been utilized, with differences being indicated with the suffix "c." Composite 30*c* comprises a plurality of layers of combustible material 12 that alternate among the plurality of structural load-bearing sheets 22. Additionally or alternatively to that shown in FIG. 17, combustible material 12 might be provided outwardly (not shown) of outermost structural load-bearing sheets 22 to form an opposing major surface among the plurality of opposing major surfaces of the combustible structural composite 30*c*.

Figure 18:
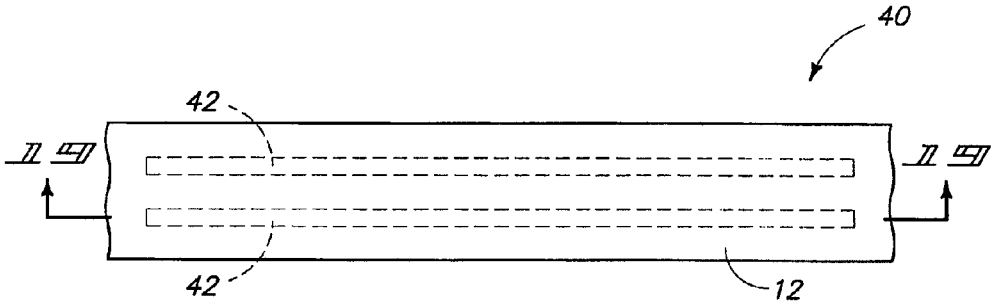
FIG. 18 is a diagrammatic top view of another combustible structural composite in accordance with an embodiment of the invention.
Figure 19:
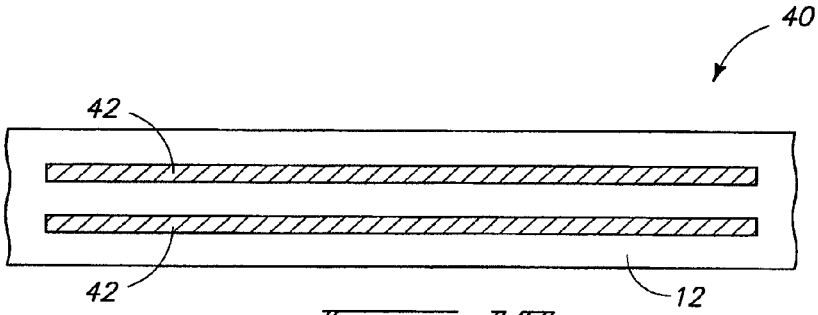
FIG. 19 is a cross-sectional view taken through section line 19-19 of FIG. 18.

An alternate embodiment of combustible structural composite 40 is shown in FIGS. 18 and 19. Like numerals from the first-described embodiments are utilized, with differences being indicated with different numerals. Combustible structural composite 40 comprises combustible material 12 and metal wire 42, as shown by dashed lines, present in the combustible structural composite 40 at a weight ratio from 1:20 to 10:1 of the metal wire 42 to the combustible material 42. A single strand of metal wire 42 might be utilized, with a plurality of strands of metal wire 42 being depicted in FIGS. 18 and 19. Metal wire 42 might be comprised of any metal or combination of metal. In one example, the metal wire 42 may be of a composition comprising the fuel metal, including of a composition consisting essentially of the fuel metal. Regardless, an example wire diameter is from 0.0005 inch to 0.100 inch. Alternative diameters might also be used. Individual strands of metal wire 42 might be spaced relative one another as shown, or alternatively be contacting one another. Furthermore, where multiple strands of metal wire 42 are used, such might be oriented parallel relative one another, or in non-parallel manners. Furthermore, such might be oriented to run along the substantial length of the combustible structural composite 40 (as shown), transverse relative to the length, or otherwise.

Figure 20:
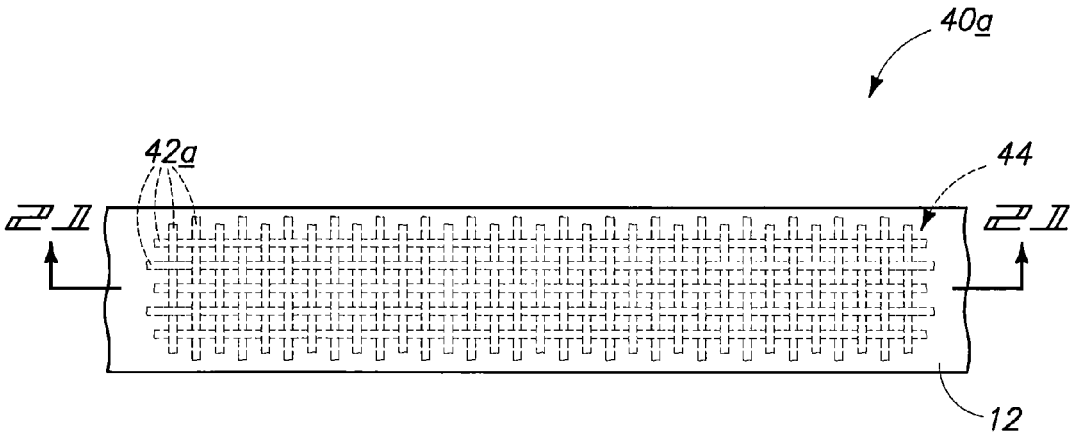
FIG. 20 is a diagrammatic top view of another combustible structural composite in accordance with an embodiment of the invention.
Figure 21:
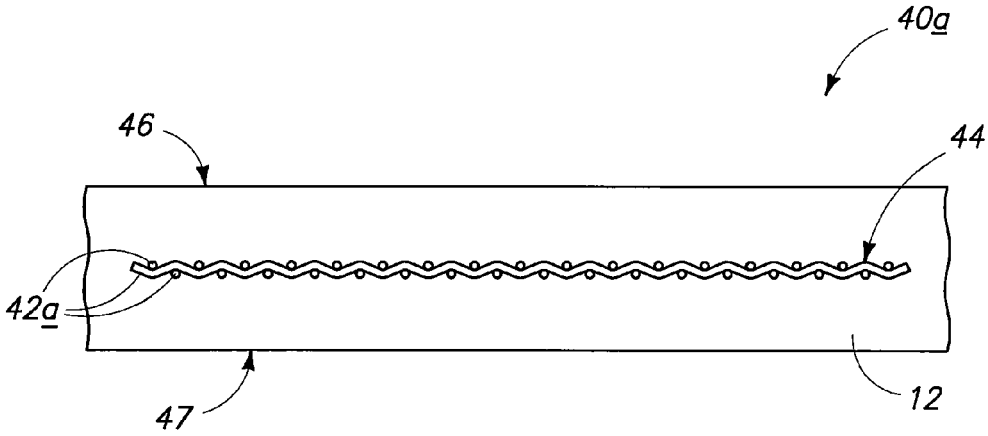
FIG. 21 is a cross-sectional view taken through section line 21-21 of FIG. 20.

FIGS. 20 and 21 depict an alternate embodiment of combustible structural composite 40*a*. Like numerals from the FIGS. 18 and 19 embodiments have been utilized, with differences being indicated with the suffix "a" or with different numerals. Combustible structural composite 40*a* comprises metal wire 42*a* which is in the form of a sheet 44. In the depicted example, the sheet 44 comprises a screen mesh. The screen mesh is depicted as being substantially centered between a plurality of opposing major surfaces 46 and 47 of composite 40*a*, although non-centered orientations are also of course contemplated. Furthermore, FIGS. 20 and 21 depict a single sheet 44, with multiples of such sheets 44 also, of course, being contemplated, and, for example, oriented as shown in any of the embodiments of FIGS. 8-17, or otherwise.

Figure 22:
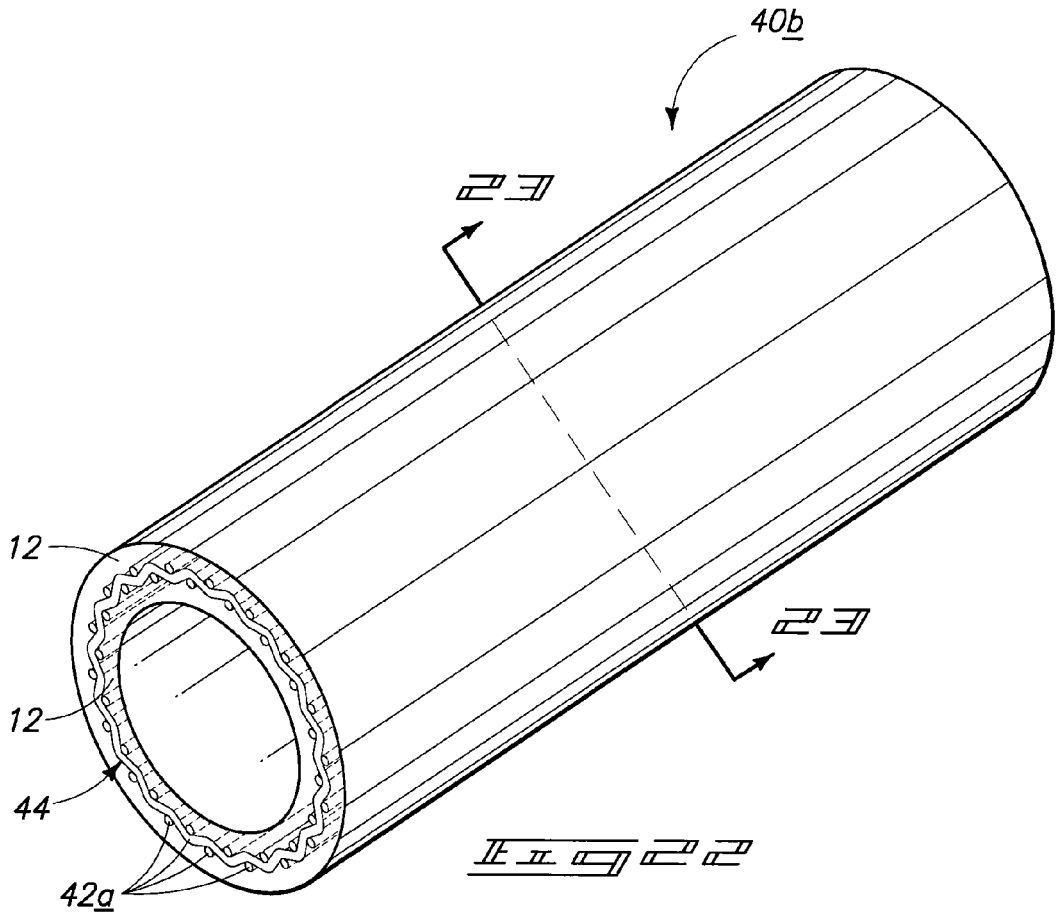
FIG. 22 is a diagrammatic isometric view of another combustible structural composite in accordance with an embodiment of the invention.
Figure 23:
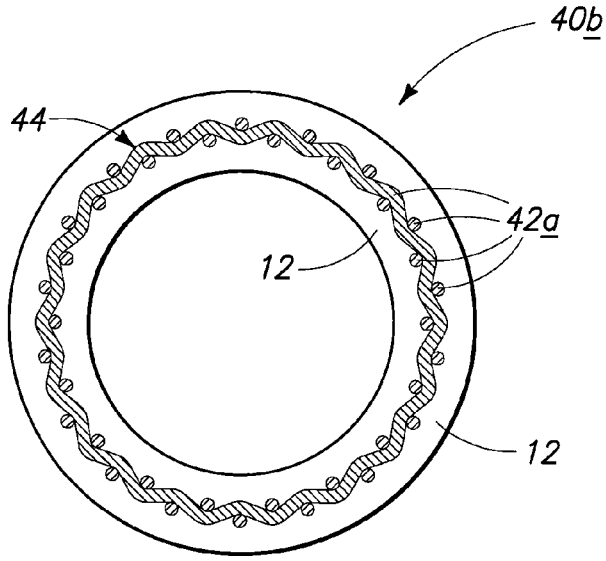
FIG. 23 is a cross-sectional view taken through section line 23-23 of FIG. 22.

An alternate embodiment of combustible structural composite 40*b* is shown in FIGS. 22 and 23. Like numerals from the FIGS. 18-21 embodiments are utilized, with differences being indicated with the suffix "b." Combustible structural composite 40*b* is depicted as being cylindrical or tubular, and comprises metal wire 42*a* in the form of a sheet 44, which is a screen mesh. Combustible material 12 is formed over and through sheet 44. Metal wire 42*a* might alternatively, or additionally, be present within a cylindrical combustible structural composite 40*b* in other than a screen mesh or other sheet, for example, and by way of example only, in manners depicted in the embodiments of FIGS. 18-21.

Figure 24:
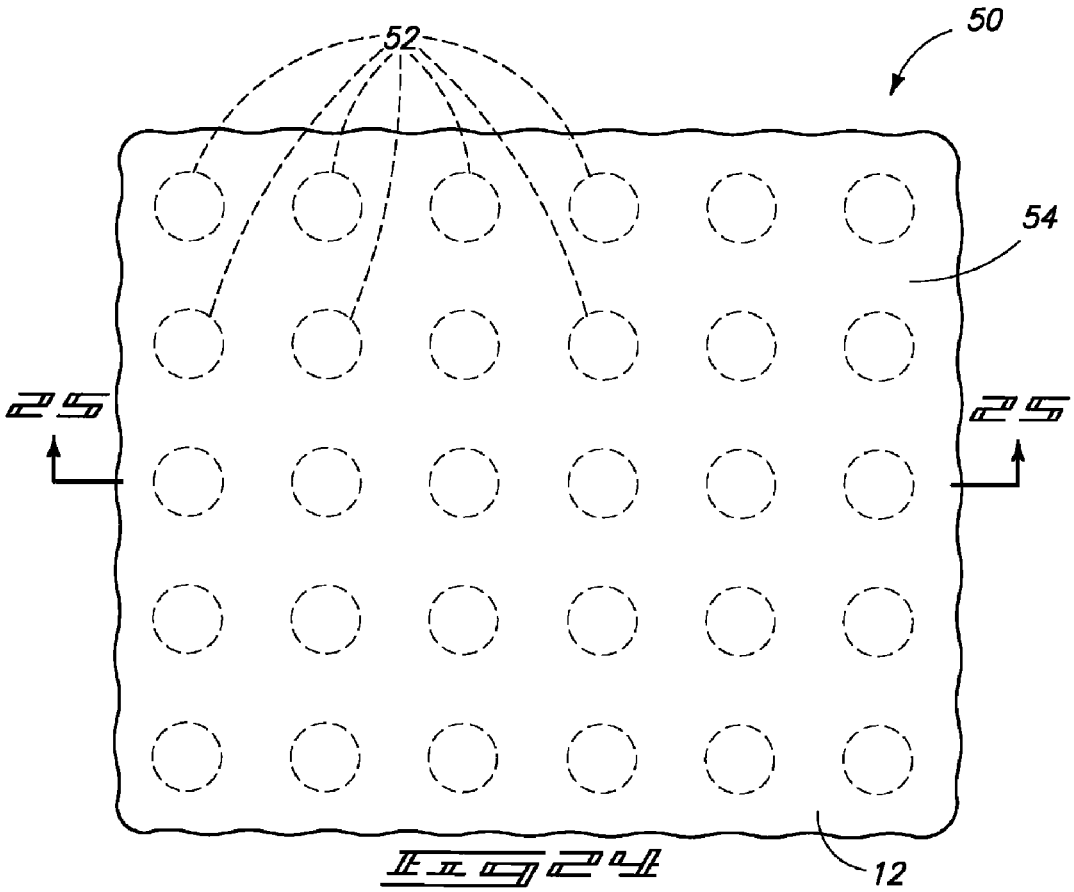
FIG. 24 is a diagrammatic top view of another combustible structural composite in accordance with an embodiment of the invention.
Figure 25:
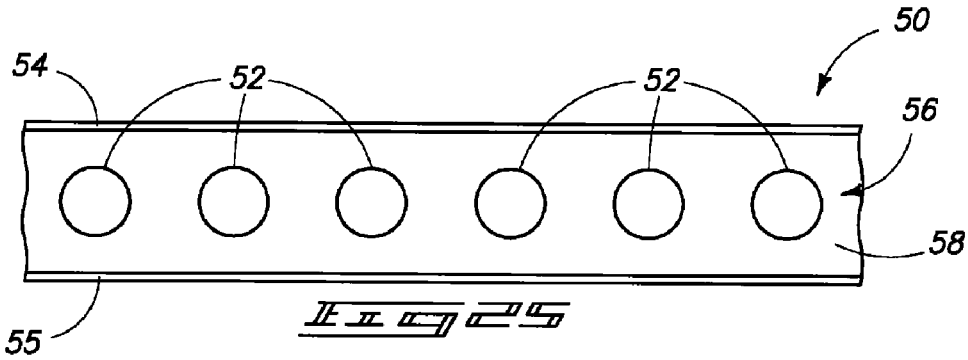
FIG. 25 is a cross-sectional view taken through section line 25-25 of FIG. 24.

Another alternate embodiment of combustible structural composite 50 is shown in FIGS. 24 and 25. Such comprises a pair of structural load-bearing sheets 54, 55 having a foam-comprising core 56 received therebetween. Structural load-bearing sheets 54, 55, by way of example only, might be composed of any of the materials and configurations of sheets described in connection with any of the embodiments of FIGS. 7-17.

Foam-comprising core 56 comprises a plurality of combustible material masses 52, as shown by dashed lines in FIG. 24, received within a foam 58. Composition of combustible material masses 52 is the same as that described above for combustible material 12. Any suitable or yet-to-be developed foam 58 is usable, with ROHACELL® available from Evonik Industries (Essen, Germany), being but one example. Combustible material masses 52 are depicted as being generally spherical and centered within foam 58 between pair of structural load-bearing sheets 54, 55. Other shapes and orientations are also of course contemplated. Furthermore, combustible structural composite 50 is depicted as having only two structural load-bearing sheets 54, 55 received on outer/external surfaces thereof. Alternatively, by way of example only, such structural load-bearing sheets 54, 55 might be received within foam 58 (less preferred), and/or alternatively a plurality of layers of pairs of structural load-bearing sheets 54, 55 and foam-comprising cores 56 might be used.

Figure 26:
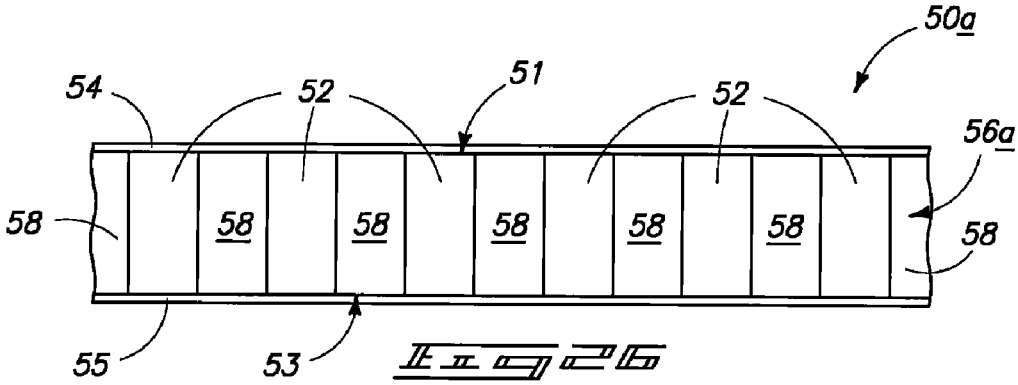
FIG. 26 is an alternate embodiment of a combustible structural composite to that shown in FIG. 25.
Figure 21:
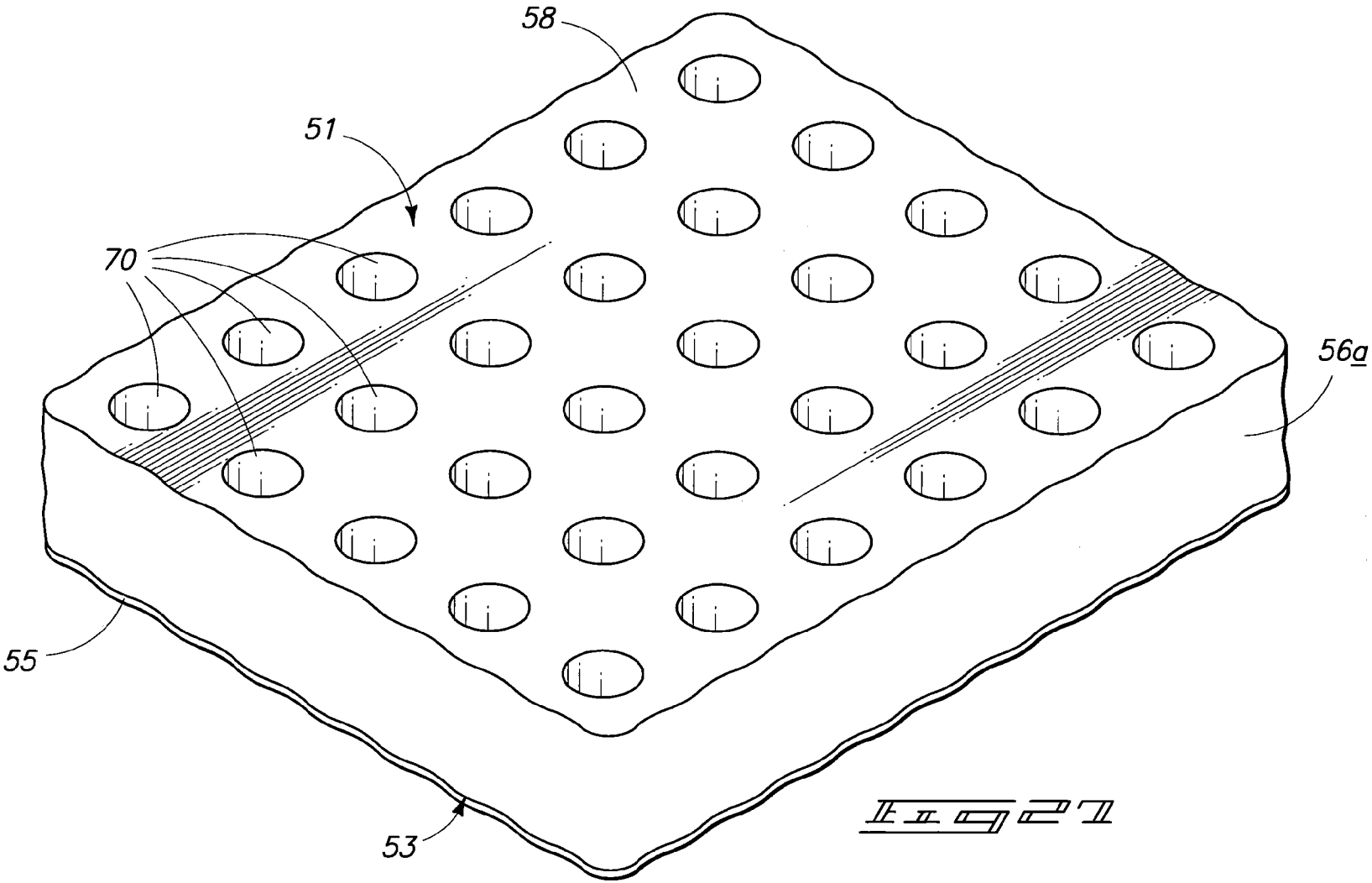

An alternate embodiment of combustible structural composite 50*a* is shown in FIG. 26. Like numerals from the FIGS. 24 and 25 embodiment have been used, with differences being indicated with the suffix "a" or with different numerals. Here, foam-comprising core 56*a* can be considered as comprising opposing major surfaces 51 and 53 each of which is received proximate different of each respective structural load-bearing sheets 54, 55. Combustible material masses 52 are shown to extend completely through foam 58 from one opposing major surface 51, 53 to the other. In one example and preferred embodiment, combustible material masses 52 are cylindrical.

The above combustible structural composites might be manufactured by any existing, or yet-to-be developed, manner, and in any shapes or configurations. In one example, a tape casting-like process might be utilized. For example, a suitable mixing container is used within which suitable binders and solvents are mixed. Powders of the fuel metal and the metal oxide are added thereto. Further, another oxidizer for the binder might also be added, such as potassium perchlorate. In one embodiment where structural-reinforcing fibers 14 are present throughout the combustible structural composite, such structural-reinforcing fibers 14 may also be added, and the mixture stirred until homogeneity is obtained.

A suitable surface which is ideally chemically inert to the solvent, for example, MYLAR™, is provided. A suitable mold shape may be provided over the surface, and the mixture poured or otherwise spread over such surface within the mold or in the absence of a mold. The resultant composition is then allowed to dry either at room temperature or at an elevated temperature to evaporate the solvent, with the binder or binders holding the resultant combustible structural composite together. The process may of course be repeated to form multiple layers and a larger combustible structural composite. The binder will likely not be combustible, and thereby may compromise the exothermic output of the combustible material 12 wherein some of the energy stored by the combustible material 12 will be utilized to decompose the binder upon burning the combustible material 12. Regardless, combustible structural composites containing binders may be subjected to further treatments, such as hot-pressing to increase their density and toughness. In such an event, much of the binder might be eliminated by exposure to the high temperatures associated with such treatments.

If using sheets of structural-reinforcing fibers, metal or other composition, or metal wire, such might be laid over a chemically inert surface with or without a mold, and the above liquid composition spread thereover. Upon cure, the process could be repeated with the solvent composition bearing the combustible material 12 with or without provision of additional structural-reinforcing sheets and/or metal wire.

An alternate example process includes hot-pressing that may use no binder. For example, structural-reinforcing fibers 14 in combination with combustible material 12 as described above may be placed into a graphite mold. Such mixture is then ideally brought to near the melting temperature of the fuel metal, and placed under high pressure. Ideally, the temperature is maintained below the melting temperature of the fuel metal, but at or above its plastic transition temperature. The combustible material 12 plastically flows together and around the reinforcing material and densifies. Pressing would occur, for example, at 10,000 psi for 15 minutes, whereupon a solidified composite of a desired shape is formed. Subsequent machining thereof may or may not be conducted.

Another example technique is a thermal spray coating process to deposit the combustible material onto structural-reinforcing material 12 with or without using a mold. Such an example process includes introducing fuel metal and metal oxide in combination or separately into a hot gas jet stream that is generated by either electric arc discharge (plasma) or oxygen-fuel combustion. The particles are heated and accelerated by the gas jet to be deposited onto a structural-reinforcing substrate (i.e., a fibrous or metal sheet, or metal wire) to form a coating thereon. An iterative approach is ideally implemented with additional combustible material 12 being deposited. Furthermore, additional reinforcing material may be laid down at desired thickness intervals.

With such a thermal spray process, the powder particles essentially melt in-flight and impact upon the surface onto which the powder particles are sprayed. Such forms a strong bond with one another and the reinforcing material. Upon completion, the combustible structural composite may or may not be densified to reduce void volume that may occur during the thermal spray process. Densification, by way of example only, might be conducted by hot press and/or hot isostatic press.

An aspect of the invention encompasses methods of forming a combustible structural composite. In one embodiment, a liquid mixture is sprayed onto and through a screen mesh. The screen mesh may comprise metal and/or other material. The screen mesh may be planar, cylindrical, or of any other desired shape or configuration. The screen mesh may rest upon a substrate or be elevated above a substrate or other surface during the spraying.

The sprayed liquid is solidified into combustible material 12 that covers a plurality of opposing surfaces of the screen mesh, with the combustible material 12 comprising a fuel metal and a metal oxide as described in the above embodiments with respect to combustible material 12. In one example of a preferred embodiment, the liquid mixture is molten and at a temperature above that of the screen mesh during the spraying. In one example of a preferred embodiment where the screen mesh comprises a cylinder, the screen mesh cylinder is rotated about its longitudinal axis during the spraying, with the solidifying forming the combustible material 12 to line an internal surface and an external surface of the cylinder. For example, the combustible structural composite **40*b* of FIGS. 22 and 23** might be formed in such a manner.

In one specific example, a tubular combustible structural composite was formed using a plasma spray process by first forming an aluminum screen substrate into a desired tubular shape. For example, an aluminum wire mesh was formed into a tubular structure of 12.7 mm in diameter by 125 mm long. The tube was rotated while a plasma torch was translated across the tube longitudinally while spraying a mixture of molten fuel metal and metal oxide with the plasma torch. The exit of the plasma torch was positioned between 25 mm and 200 mm from the rotating tubular structure. The process was repeated multiple times until a desired coating was provided internally and externally on the wire mesh. The process further may be repeated to provide a thicker external coating on the tubular structure than internally within the tubular structure upon complete covering of the openings in the wire mesh.

The plasma torch was operated using 10 standard liters per minute (slm) to 60 slm of argon and from 0 slm to 20 slm of helium. Torch current was adjusted between 400 amps and 1,000 amps. The result was a free-standing tubular structure approximately 13.7 mm in diameter with an internal and external wall thickness greater than 1 mm. Not including the wire mesh substrate, the tubular structure was composed of approximately 32% by weight fuel metal, 65% by weight combustible material, and 3% porosity.

The combustible structural composites 50 described above in connection with FIGS. 24 and 25 might also be manufactured in accordance with any existing or yet-to-be developed methods. For example, and by way of example only, a structural foam core comprising combustible material masses 52 could be sprayed or otherwise provided in liquid form onto a structural load-bearing sheet 54, 55, and then solidified into a solid foam. Another structural load-bearing sheet 54, 55 could be bonded thereto or otherwise connected therewith. Furthermore, by way of example only, a liquid foam comprising combustible material masses 52 therein could be injected between a pair of structural load-bearing sheets 54, 55 and solidified to bond with each of the load-bearing sheets 54, 55 during a solidification process.

An aspect of the invention also encompasses forming a combustible structural composite **50*a*, for example, as described in connection with FIGS. 27-29 in forming the example combustible structural composite 50*a* of FIG. 26. Like numerals from FIG. 26 have been used, with differences being indicated with different numerals. Referring to FIG. 27, a foam-comprising sheet 58 has been bonded to or with a structural load-bearing sheet 55. A plurality of holes 70 has been formed to extend into foam-comprising sheet 58. In one example embodiment and as shown, holes 70 have been formed to extend transversally and completely through foam-comprising sheet 58 from major opposing surface 51 to the other major opposing surface 53**.

Figure 28:
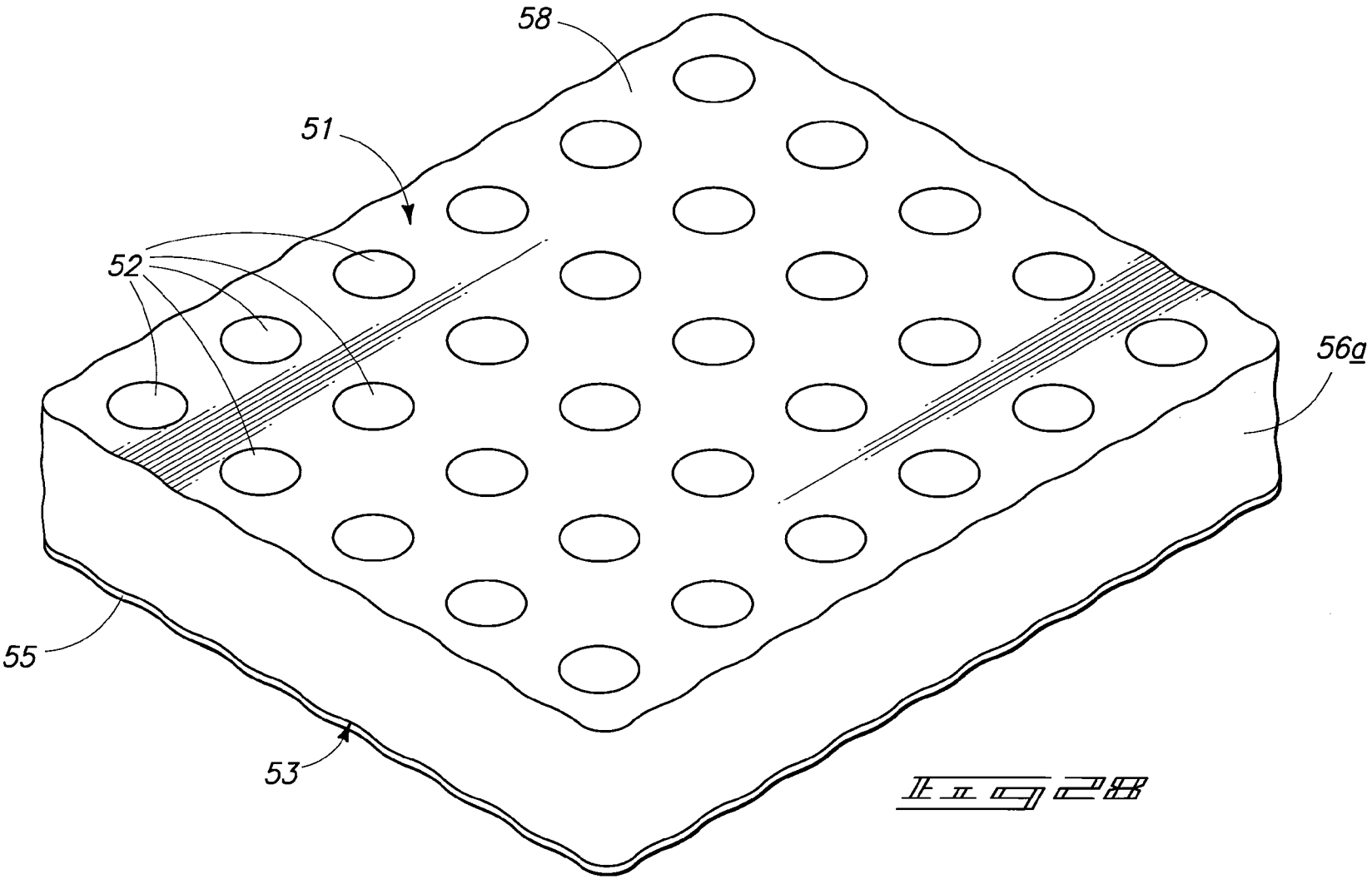
FIG. 28 is a view of the combustible structural composite of FIG. 27 at a processing step subsequent to that shown in FIG. 27.

Referring to FIG. 28, a combustible material mass 52 has been inserted into at least a hole among the plurality of holes 70 in the foam-comprising sheet 58. A combustible material mass 52 might be loosely or tightly received within a hole 70, and may or may not be glued therewithin with a suitable adhesive.

Figure 29:
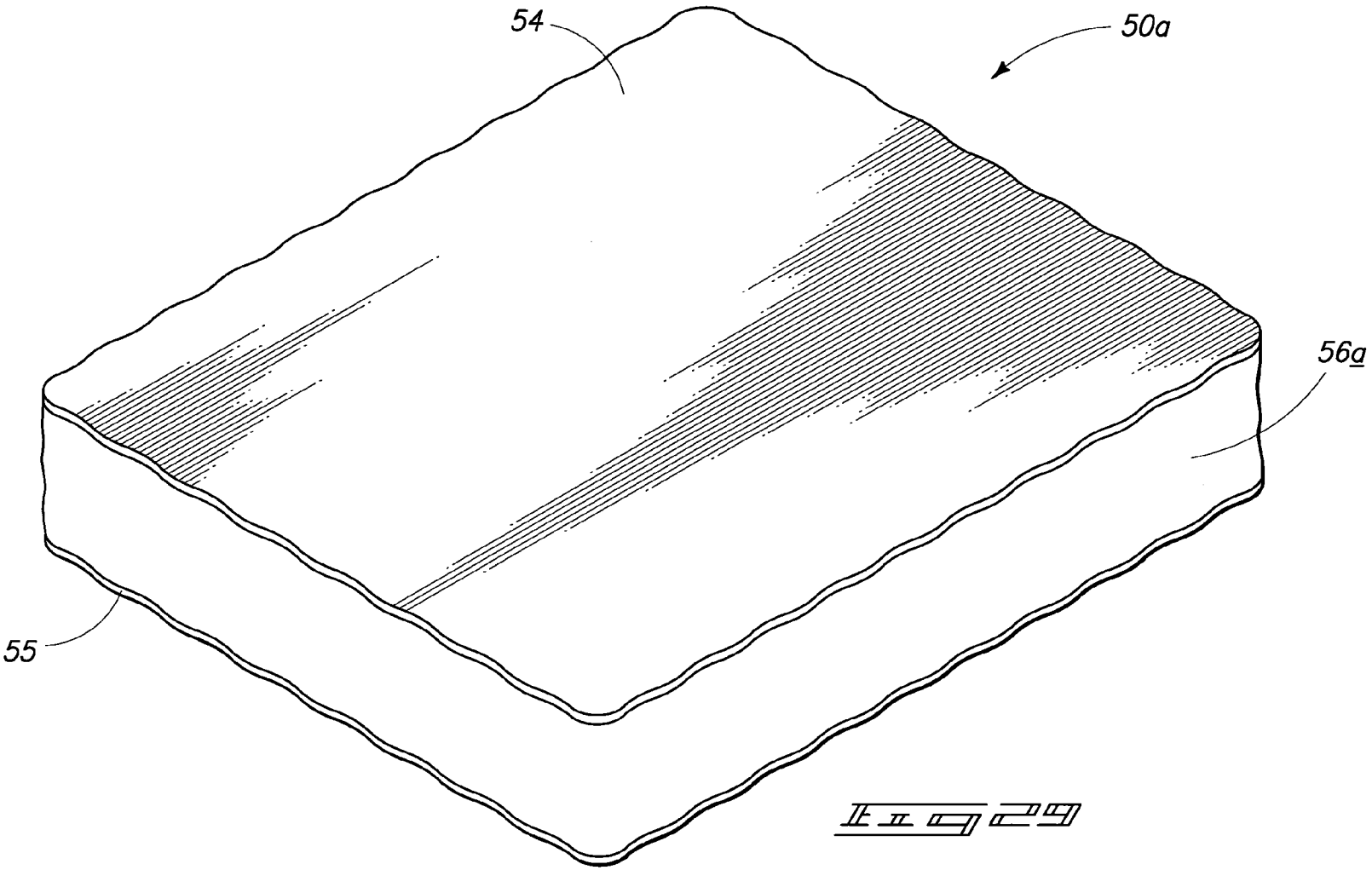
FIG. 29 is a view of the combustible structural composite of FIG. 28 at a processing step subsequent to that shown in FIG. 28.

Referring to FIG. 29, structural load-bearing sheet 54 has been bonded to the foam-comprising sheet 58 having combustible material masses 52 (not visible in FIG. 29) received therewithin.

In compliance with the statute, the invention has been described in language more or less specific as to structural and methodical features. It is to be understood, however, that the invention is not limited to the specific features shown and described, since the means herein disclosed comprise preferred forms of putting the invention into effect. The invention is, therefore, claimed in any of its forms or modifications within the proper scope of the appended claims appropriately interpreted in accordance with the doctrine of equivalents.

The invention claimed is:

1. A combustible structural composite, comprising:

a combustible material comprising a fuel metal and a metal oxide, the fuel metal and the metal oxide present in the combustible material at a weight ratio of from 1:9 to 1:1 of the fuel metal to the metal oxide; and a plurality of structural-reinforcing fibers in the combustible material, the plurality of structural-reinforcing fibers and combustible material present in the combustible structural composite at a weight ratio of from 1:2 to 2:1 of the structural-reinforcing fibers to the combustible material.

2. The combustible structural composite of claim 1, wherein the fuel metal is in an elemental form.

3. The combustible structural composite of claim 1, wherein the fuel metal is an alloy of elemental metals.

4. The combustible structural composite of claim 1, wherein the fuel metal comprises at least one metal selected from the group consisting of aluminum, titanium, zirconium, and magnesium.

5. The combustible structural composite of claim 1, wherein the fuel metal comprises aluminum in alloy form.

6. The combustible structural composite of claim 1, wherein the fuel metal comprises magnalium.

7. The combustible structural composite of claim 1, wherein the metal oxide comprises an oxide of a metal selected from the group consisting of iron, copper, boron, chromium, manganese, lead, and silicon.

8. The combustible structural composite of claim 1, wherein the fuel metal is present in the combustible material at a weight ratio from 1:4 to 3:7 of the fuel metal to the metal oxide.

9. The combustible structural composite of claim 1, wherein the plurality of structural-reinforcing fibers comprises fibers selected from the group consisting of glass fibers, carbon fibers, aramid fibers, and combinations thereof.

10. The combustible structural composite of claim 1, wherein the structural-reinforcing fibers contact the combustible material.

11. The combustible structural composite of claim 1, wherein the plurality of structural-reinforcing fibers is received within the combustible material.

12. The combustible structural composite of claim 1, wherein the plurality of structural-reinforcing fibers is distributed homogenously within the combustible material.

13. The combustible structural composite of claim 1, wherein the plurality of structural-reinforcing fibers is provided in the combustible structural composite as at least one sheet.

14. The combustible structural composite of claim 13, wherein the structural-reinforcing fibers contact the combustible material.

15. The combustible structural composite of claim 13, wherein the at least one sheet is covered on opposing sides by the combustible material.

16. The combustible structural composite of claim 13, wherein:

the at least one sheet comprises a plurality of opposing major surfaces; and the combustible material is provided to cover only a single surface among the plurality of opposing major surfaces.

17. The combustible structural composite of claim 13, wherein the at least one sheet comprises a plurality of sheets.

18. The combustible structural composite of claim 1, wherein the fuel metal and the metal oxide are capable of exothermically reacting upon application of energy at or above a threshold value to support self-sustaining combustion of the combustible material within the combustible structural composite.

19. A method of forming a combustible structural composite, comprising:

combining a fuel metal and a metal oxide to form a liquid mixture of a combustible material, the fuel metal present in the combustible material at a weight ratio from 1:9 to 1:1 of the fuel metal to the metal oxide; and adding structural-reinforcing fibers to the liquid mixture of the combustible material to form a liquid mixture of the combustible structural composite, the structural-reinforcing fibers present in the combustible structural composite at a weight ratio from 1:2 to 2:1 of the structural-reinforcing fibers to the combustible material.

20. The method of claim 19, wherein combining a fuel metal and a metal oxide to form a liquid mixture of a combustible material comprises combining the fuel metal and the metal oxide with a solvent.

21. The method of claim 20, further comprising applying the liquid mixture of the combustible structural composite to a surface that is chemically inert to the solvent.

22. The method of claim 21, further comprising removing the solvent.

23. The method of claim 19, wherein adding structural-reinforcing fibers to the liquid mixture of the combustible material comprises combining the structural-reinforcing fibers, fuel metal, and metal oxide to form a homogeneous liquid mixture of the combustible structural composite.

24. The combustible structural composite of claim 1, wherein the plurality of structural-reinforcing fibers is distributed non-homogenously in the combustible material.

25. The combustible structural composite of claim 1, wherein the plurality of structural-reinforcing fibers comprises a non-combustible material.

* * * * *